US007811419B2

(12) United States Patent
Tonello

(10) Patent No.: US 7,811,419 B2
(45) Date of Patent: Oct. 12, 2010

(54) PRESS APPARATUS FOR REMOVING WATER FROM A WEB

(75) Inventor: Fabrizio Tonello, Pinerolo (IT)

(73) Assignee: PMT Italia, Pinerolo (IT)

( * ) Notice: Subject to any disclaimer, the term of this patent is extended or adjusted under 35 U.S.C. 154(b) by 959 days.

(21) Appl. No.: 10/549,000

(22) PCT Filed: Mar. 31, 2003

(86) PCT No.: PCT/IT03/00192

§ 371 (c)(1),
(2), (4) Date: Dec. 21, 2006

(87) PCT Pub. No.: WO2004/088229

PCT Pub. Date: Oct. 14, 2004

(65) Prior Publication Data

US 2007/0175606 A1 Aug. 2, 2007

(51) Int. Cl.
*D21F 3/02* (2006.01)
*B30B 3/02* (2006.01)

(52) U.S. Cl. ..... 162/358.3; 162/205; 100/37; 100/153; 100/156

(58) Field of Classification Search ..... 162/358.3, 162/358.4, 358.1, 204, 205; 100/37, 118, 100/153, 156; 492/20, 7
See application file for complete search history.

(56) References Cited

U.S. PATENT DOCUMENTS 4,707,222 A * 11/1987 Mullner et al. ..... 162/205
6,210,530 B1 * 4/2001 Loser et al. ..... 162/205
6,254,728 B1 * 7/2001 Henssler et al. ..... 162/205
2002/0092639 A1 * 7/2002 Ishii et al. ..... 162/358.2

FOREIGN PATENT DOCUMENTS

WO WO 02/064885 * 8/2002

* cited by examiner

*Primary Examiner*—Eric Hug
(74) *Attorney, Agent, or Firm*—David J. Archer

(57) ABSTRACT

A press apparatus (10) is disclosed for removing water from a web (W). The apparatus includes a rotatable roll (12) which defines a peripheral surface (14). An elongate shoe (16) has a curved surface (18) which cooperates with the peripheral surface (14) of the roll (12) for defining therebetween a nip (N) for the passage therethrough of the web (W). The arrangement is such that when the web (W) extends through the nip (N), water is pressed from the web (W). A blanket (20) is disposed between the curved surface (18) of the shoe (16) and the web (W) for supporting the web (W) during the passage of the web through the nip (N), the blanket (20) enclosing the shoe (16). Moreover, the blanket (20) has a diameter within a range 500 mm to 875 mm.

19 Claims, 3 Drawing Sheets

PRESS APPARATUS FOR REMOVING WATER FROM A WEB

BACKGROUND OF THE INVENTION

1. Field of the Invention

The present invention relates to a press apparatus for removing water from a web. More particularly, the present invention relates to a press apparatus for removing water from a web, the press apparatus including a press shoe and a blanket enclosing the press shoe.

2. Background Information

An extended nip or shoe press was born in the 1980's for liner and corrugating medium papermaking machines with the aim of achieving the highest ex press dryness values. To reach the objective of achieving these high dryness values, high nip loads (from 1050 to 1500 kN/m) and long nips (standard 250 mm) were the main features of those shoe presses.

During the 1990's shoe presses were developed for application to fine paper grades due to the evidence that for the same dryness achievable with a roll press, a shoe press was able to give higher paper bulk or for the same bulk a higher ex press dryness. For fine paper applications it was discovered that in order to achieve the common values of bulk, the specific pressure under the nip had to be reduced to 50 60% of the pressure normally used on fluting and liner applications. Accordingly, this resulted in typical nip loads within a range 450/550 kN/m.

Medium or high nip loads of necessity mean that the shoe press and counter roll construction must be quite heavy and relatively large in size. Consequently, due to the relatively massive size and weight of typical extended nip presses, the impact especially in rebuild projects was in certain respects negative. More specifically, the advent of the shoe press had quite a big impact on the press layout (due to the relatively large size), on the press frame, machine building, lifting crane capacity (due to the high nip forces, and heavy weights involved) and finally on the time required from the request for such rebuild until operation of such rebuild. For the aforementioned reasons several shoe press projects have been cancelled because the projected total cost was out of budget. Additionally, because of uncertainty about return on investment and the rebuilding shut down time being too long, such rebuilds were often considered not acceptable for production continuity.

Accordingly, the basic concept of the invention is to provide a small and light shoe press unit (700 mm dia.), called a mini shoe press providing an extended nip with reduced nip load, (max 200 kN/m) and a proportionally reduced nip length (70 100 mm only). The lighter load combined with shorter nip according to the present invention provides the same specific pressure under the nip as a typical conventional shoe press unit.

The results in terms of bulk/dryness gains according to the present invention are somewhere midway between a conventional roll press and a standard shoe press. This has to be evaluated together with the lower impact in terms of budget, press layout, framing and building, shut down time associated with the mini shoe press installation according to the present invention compared with a conventional prior art shoe press.

Accordingly, the return on investment (ROI) is favourable to the mini shoe press arrangement according to the present invention.

Because of the unique size of the mini extended nip press arrangement according to the present invention, certain features of the structure and the pressures used are unique to the arrangement according to the present invention.

More specifically, the mini shoe press head design incorporates the blanket mechanical clamping concept disclosed in co-pending application No. PCT/EP01/01960.

Accordingly, the radial compactness of the system according to the present invention enabled the reduction of the mini shoe press outside diameter to 700 mm. However, if a typical clamping system used on a more conventional enclosed shoe press, with the exception of the arrangement disclosed in the aforementioned pending application were to be used, the attainment of such a small outside diameter would have been very difficult.

Another important feature of the present invention is the provision of an arrangement which permits adequate removal of lubricant from the enclosure defined by the blanket.

In a conventional shoe press, lubrication oil is pumped (hundreds of litres per minute that is 1 pm) inside the unit or enclosure. After use, the lubricant or oil is then collected inside the unit or enclosure into saveall pans and then conveyed to the outside of the unit through a relatively large channel ($^{170}/_{190}$ mm diameter) drilled into the back side journal. The inside or enclosure of the unit is also pressurized by a relatively light air pressure (35 mbars). The objective of the light or slight air pressure is to provide the required machine direction blanket tension. To be able to stay pressurized, the inside of the shoe press is perfectly sealed from the outside.

The oil discharge channel is sealed by a syphon to prevent internal air from leaking through the oil free portion of the channel above the oil bath or pan.

According to these principles, oil flows out of the unit purely assisted by gravity. This system works quite well as it is well balanced. More specifically, the amount of oil that is pumped into the unit is the same as the amount of oil drained by gravity out of the unit. Such flow of lubricant through the unit or enclosure does not interfere with the air pressure inside the unit. The only disadvantage is that this system as applied to conventional enclosed shoe presses requires quite a big cross sectional area for the drain channel due to the relatively low speed of the oil flowing out just by gravity. This feature is not a problem on a relatively large size unit thanks to the relatively massive size of the journals.

However, in a mini shoe press according to the present invention, the amount of oil required for the lubrication of the shoe is of the same magnitude as for a conventional shoe press. On the other hand, due to the reduced size of the journals in the mini press according to the present invention, it would be almost impossible to have a reasonable size for the drain channel to remove the oil in a passive way by gravity. Therefore, the oil extraction must be assisted by a suction pump to increase the oil flow speed and thus permit a reduced channel cross sectional area size. On the other hand it is practically impossible to have both injection and extraction of oil operated by pumps. More particularly, it would be impossible to have a constantly balanced system. Also, the air pressure inside the unit would be unstable. For example, if the suction pump sucks an amount of oil B which differs even only slightly from the amount of oil A pumped by the supply pump, the result would be that either 1/ the oil little by little fills the unit (when A is bigger than B) or 2/ the suction pump from time to time sucks air to compensate for a lack of oil (when B is bigger than A) which would result in instability of the air pressure inside the unit or enclosure. On the other hand it is practically impossible to maintain constantly the ideal condition in which A=B.

According to the concept of the present invention, the aforementioned problems are overcome by the provision of a supply pump having a pumping capacity A which is slightly greater than the capacity of the suction pump B.

Inside the mini shoe press unit or enclosure, two oil pans are provided. One of the pans, that is a primary pan is connected through an overflow to a secondary pan.

All the amount of oil A will be primarily collected by the primary pan from which the suction pump will take the amount B. However, B<A. Corresponding to the full capacity of the suction pump, the quantity B will be evacuated out of the unit through a hole the cross sectional area or size of which can be very small due to the high flow speed given to the oil by the suction pump.

The difference A–B, which=C will be transferred to the secondary pan through the overflow.

The amount of oil C will passively flow out of the unit or enclosure by gravity through a syphon similar to the type of syphon used in a conventional shoe press. The amount of oil C being only a small fraction of A such as 10%, only a channel of relatively small cross sectional area will be needed through the back side journal of the mini shoe press unit. More specifically, the channel will have a diameter of 80-100 mm instead of 170-190 mm needed in a conventional enclosed shoe press.

In summary, according to the present invention, there will be two channels to remove the oil from the unit or enclosure. Both of the channels will be relatively small in cross sectional area and they will easily fit into the small journal of the mini shoe press. The primary drain channel will be connected to the suction pump. Most of the oil (B, for example, 90% of total) will flow through this channel at a high velocity due to the pumping action. The secondary channel will be assisted only by gravitational force. The second channel will drain the rest of the oil (C, for example, 10%) at low velocity.

Therefore, it is a primary feature of the present invention to provide a press apparatus for removing water from a web that overcomes the problems associated with the prior art arrangements.

Another feature of the present invention is the provision of a press apparatus for removing water from a web that simplifies the manufacture of a rebuild papermaking press section.

A further feature of the present invention is the provision of a press apparatus for removing water from a web that reduces the cost of a rebuild papermaking press section.

Other features and advantages of the present invention will be readily apparent to those skilled in the art by a consideration of the detailed description of a preferred embodiment of the present invention contained herein.

SUMMARY OF THE INVENTION

The present invention relates to a press apparatus for removing water from a web. The apparatus includes a rotatable roll which defines a peripheral surface. An elongate shoe has a curved surface which cooperates with the peripheral surface of the roll for defining therebetween a nip for the passage therethrough of the web. The arrangement is such that when the web extends through the nip, water is pressed from the web. A blanket is disposed between the curved surface of the shoe and the web for supporting the web during the passage of the web through the nip, the blanket enclosing the shoe. Moreover, the blanket has a diameter within a range 500 mm to 875 mm.

In a more specific embodiment of the present invention, the roll is rotatable about a longitudinal axis and the roll includes a first and a second side, the peripheral surface extending between the first and the second side of the roll.

Furthermore, the curved surface of the shoe has a machine direction length within a range 40 mm to 130 mm.

More specifically, the curved surface of the shoe has a machine direction length within a range 50 mm to 120 mm.

Preferably, the curved surface of the shoe has a machine direction length within a range 60 mm to 110 mm.

In a preferred embodiment of the present invention, the curved surface of the shoe has a machine direction length within a range 70 mm to 100 mm.

Additionally, the press apparatus according to the present invention further includes a mechanism for urging the elongate shoe towards the roll.

Moreover, the mechanism urges the shoe towards the roll with a pressure up to 220 kN/m.

More specifically, the mechanism urges the shoe towards the roll with a pressure up to 210 kN/m.

Preferably, the mechanism urges the shoe towards the roll with a pressure up to 200 kN/m.

Also, the blanket has a diameter within a range 650 mm to 750 mm and preferably, the blanket has a diameter within a range 690 mm to 710 mm.

Furthermore, the blanket has a first and a second edge, a first distance between the first and the second edge of the blanket being greater than a second distance between the first and the second side of the roll.

The press apparatus further includes an axle which defines a first and a second journal the second journal being spaced axially relative to the first journal.

Also, a first head is rotatably connected to the first journal. Additionally, a second head is rotatably connected to the second journal.

The first head defines a periphery which cooperates with the first edge of the blanket.

Moreover, the second head defines a further periphery which cooperates with the second edge of the blanket such that when the heads are rotated about the respective journals, the blanket slides over the curved surface of the shoe so that the blanket and the heads define an enclosure. The shoe is sealed within the enclosure.

The apparatus according to the present invention further includes an anchor device for anchoring the first edge of the blanket. The anchor device includes a conical peripheral surface defined by the periphery of the first head for supporting the blanket.

A ring defines a concave surface which cooperates with the conical surface of the first rotatable head such that the first edge of the blanket is anchored between the conical surface of the first head and the concave surface of the ring.

A pin extends radially inwardly from the ring, the pin engaging a hole defined by the first edge of the blanket.

Additionally, a plurality of barbs extend away from the concave surface of the ring for assisting in anchoring the first edge of the blanket against the conical surface of the first rotatable head.

An urging mechanism is provided for urging the conical surface of the first head axially away from the shoe so that the conical surface moves towards the concave surface of the ring such that the first edge of the blanket is wedged between the conical surface of the first head and the concave surface of the ring. The arrangement is structured such that when the blanket extends through the nip and during subsequent flexing of the blanket, the first edge of the blanket is firmly anchored to the conical surface of the first rotatable head.

Also, a further conical peripheral surface is defined by the further periphery of the second head for supporting the blanket.

A further ring defines a further concave surface which cooperates with the further conical surface of the second rotatable head such that the second edge of the blanket is anchored between the further conical surface of the second head and the further concave surface of the further ring.

A further pin extends radially inwardly from the further ring, the further pin engaging a further hole defined by the second edge of the blanket.

A further plurality of barbs extend away from the further concave surface of the further ring for assisting in anchoring the second edge of the blanket against the further conical surface of the second rotatable head.

Furthermore, a further urging mechanism is provided for urging the further conical surface of the second head axially away from the shoe so that the further conical surface moves towards the further concave surface of the further ring such that the second edge of the blanket is wedged between the further conical surface of the second head and the further concave surface of the further ring. The arrangement is structured such that when the blanket extends through the nip and during subsequent flexing of the blanket, the second edge of the blanket is firmly anchored to the further conical surface of the second rotatable head.

The press apparatus also includes a lubrication system for lubricating the curved surface of the shoe for reducing friction between the curved surface and the blanket during the passage of the web supported by the blanket through the nip.

More specifically, the lubrication system includes a supply pump for supplying lubricant from a source of lubricant through one of the journals to the curved surface of the shoe.

A primary pan is provided within the enclosure for receiving therein used lubricant from the curved surface.

A secondary pan receives therein used lubricant overflowing from the primary pan.

Additionally, a suction pump is connected to the primary pan through one of the journals for removing the used lubricant from the primary pan. The supply pump has a larger capacity than the suction pump. The arrangement is structured such that excess used lubricant overflowing into the secondary pan drains by gravity from the secondary pan through the journal.

More particularly, the journal defines a first passage for a first flow therethrough of the used lubricant removed by the suction pump from the primary pan.

Also, the journal defines a second passage for a second flow therethrough of the used lubricant removed by gravity from the secondary pan.

Furtheremore, the journal defines a third passage for a third flow therethrough of the lubricant supplied to the curved surface of the shoe.

Additionally, the press apparatus further includes a syphon which operably connects the secondary pan to the second passage for maintaining a stabilized air pressure within the enclosure.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

BRIEF DESCRIPTION OF THE DRAWINGS

Similar reference characters refer to similar parts throughout the various views of the drawings.

DETAILED DESCRIPTION OF THE DRAWINGS

Figure 1:
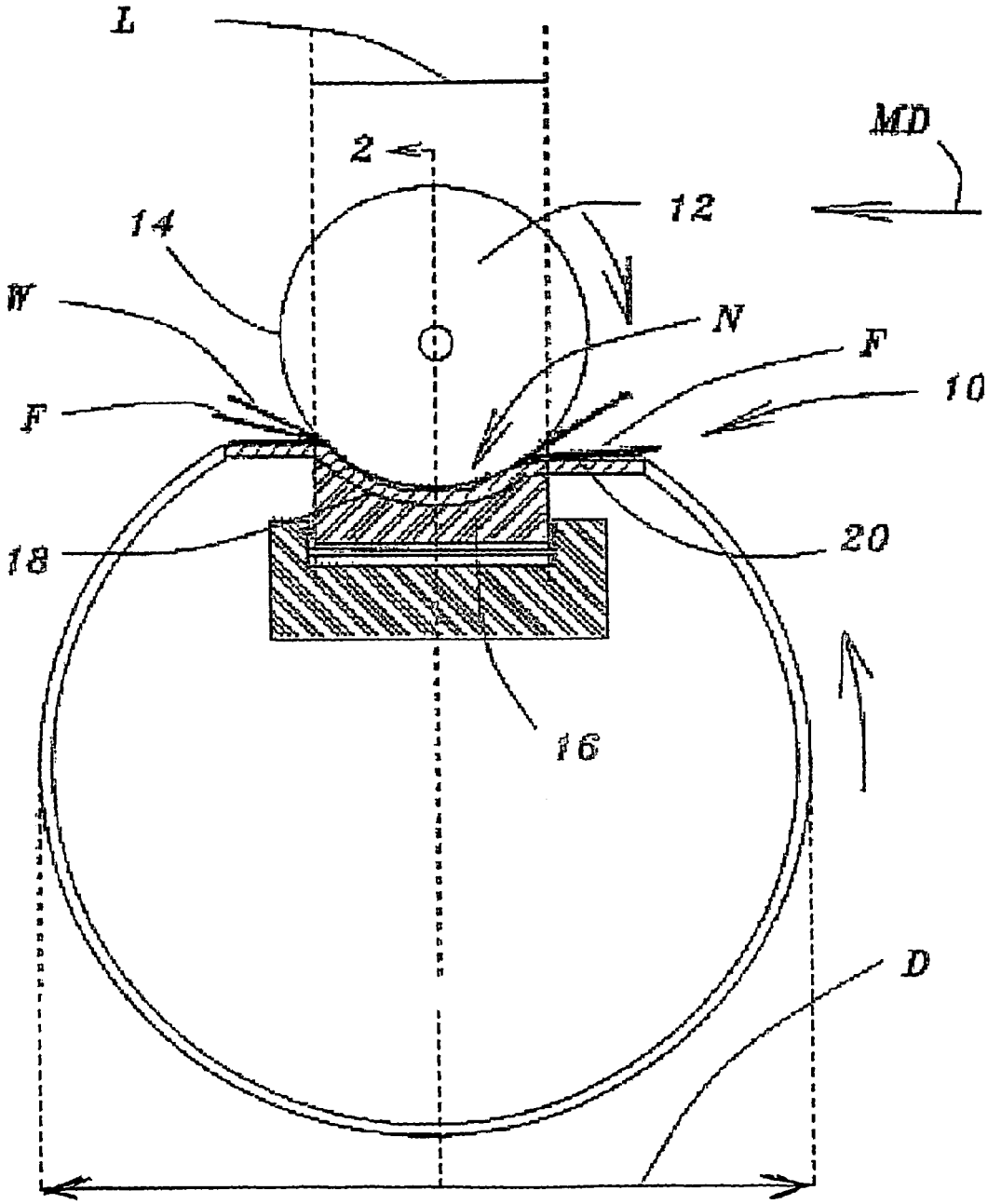
FIG. 1 is a side elevational view partially in section of a press apparatus according to the present invention for removing water from a web.

FIG. 1 is a side elevational view partially in section of a press apparatus generally designated 10 according to the present invention for removing water from a web W. As shown in FIG. 1, the apparatus 10 includes a rotatable roll 12 which defines a peripheral surface 14. An elongate shoe 16 has a curved surface 18 which cooperates with the peripheral surface 14 of the roll 12 for defining therebetween a nip N for the passage therethrough of the web W. The arrangement is such that when the web W extends through the nip N, water is pressed from the web W. A blanket 20 is disposed between the curved surface 18 of the shoe 16 and the web W for supporting the web W during the passage of the web W through the nip N, the blanket 20 enclosing the shoe 16. Moreover, the blanket 20 has a diameter D within a range 500 mm to 875 mm.

Figure 2:
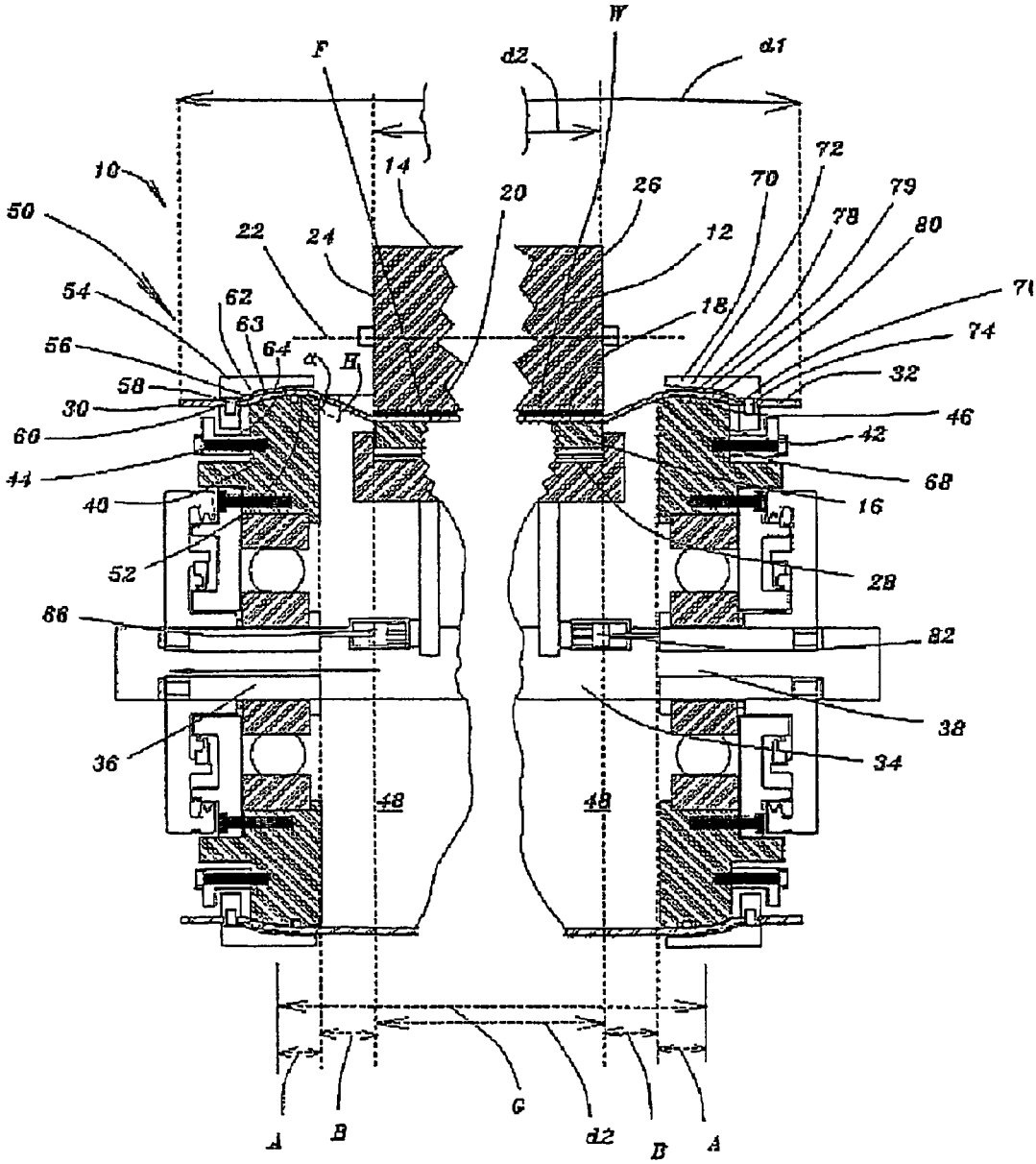
FIG. 2 is an enlarged sectional view taken on the line 2-2 of FIG. 1.

FIG. 2 is an enlarged sectional view taken on the line 2-2 of FIG. 1. As shown in FIG. 2, the roll 12 is rotatable about a longitudinal axis 22 and the roll 12 includes a first and a second side 24 and 26 respectively, the peripheral surface 14 extending between the first side 24 and the second side 26 of the roll 12.

Furthermore, as shown in FIG. 1, the curved surface 18 of the shoe 16 has a machine direction (MD) length L within a range 40 mm to 130 mm.

More specifically, the curved surface 18 of the shoe 16 has a machine direction length L within a range 50 mm to 120 mm.

Preferably, the curved surface 18 of the shoe 16 has a machine direction length L within a range 60 mm to 110 mm.

In a preferred embodiment of the present invention, the curved surface 18 of the shoe 16 has a machine direction length L within a range 70 mm to 100 mm.

Additionally, as shown in FIG. 2, the press apparatus 10 according to the present invention further includes a mechanism 28 for urging the elongate shoe 16 towards the roll 12.

Moreover, the mechanism 28 urges the shoe 16 towards the roll 12 with a pressure up to 220 kN/m.

More specifically, the mechanism 28 urges the shoe 16 towards the roll 12 with a pressure up to 210 kN/m.

Preferably, the mechanism 28 urges the shoe 16 towards the roll 12 with a pressure up to 200 kN/m.

Also, as shown in FIG. 1, the blanket 20 has a diameter D within a range 650 mm to 750 mm and preferably, the blanket 20 has a diameter D within a range 690 mm to 710 mm.

Furthermore, as shown in FIG. 2, the blanket 20 has a first and a second edge 30 and 32 respectively, a first distance d1 between the first edge 30 and the second edge 32 of the blanket 20 being greater than a second distance d2 between the first side 24 and the second side 26 of the roll 12.

The press apparatus 10 further includes an axle 34 which defines a first and a second journal 36 and 38 respectively, the second journal 38 being spaced axially relative to the first journal 34.

Also, a first head 40 is rotatably connected to the first journal 36. Additionally, a second head 42 is rotatably connected to the second journal 38.

The first head 40 defines a periphery 44 which cooperates with the first edge 30 of the blanket 20.

Moreover, the second head 42 defines a further periphery 46 which cooperates with the second edge 32 of the blanket 20 such that when the heads 40 and 42 respectively are rotated about the journals 36 and 38 respectively, the blanket 20 slides over the curved surface 18 of the shoe 16 so that the blanket 20 and the heads 40 and 42 define therebetween an enclosure 48. The shoe 16 is sealed within the enclosure 48.

The apparatus 10 according to the present invention further includes an anchor device generally designated 50 for anchoring the first edge 30 of the blanket 20. The anchor device 50 includes a conical peripheral surface 52 defined by the periphery 44 of the first head 40 for supporting the blanket 20.

A ring 54 defines a concave surface 56 which cooperates with the conical surface 52 of the periphery 44 of the first rotatable head 40 such that the first edge 30 of the blanket 20 is anchored between the conical surface 52 of the first head 40 and the concave surface 56 of the ring 54.

A pin 58 extends radially inwardly from the ring 54, the pin 58 engaging a hole 60 defined by the first edge 30 of the blanket 20.

Additionally, a plurality of barbs 62, 63 and 64 extend away from the concave surface 56 of the ring 54 for assisting in anchoring the first edge 30 of the blanket 20 against the conical surface 52 of the first rotatable head 40.

An urging mechanism 66 is provided for urging the conical surface 52 of the first head 40 axially away from the shoe 16 so that the conical surface 52 moves towards the concave surface 56 of the ring 54 such that the first edge 30 of the blanket 20 is wedged between the conical surface 52 of the first head 40 and the concave surface 56 of the ring 54. The arrangement is structured such that when the blanket 20 extends through the nip N and during subsequent flexing of the blanket 20, the first edge 30 of the blanket 20 is firmly anchored to the conical surface 52 of the first rotatable head 40.

Also, a further conical peripheral surface 68 is defined by the further periphery 46 of second head 42 for supporting the blanket 20.

A further ring 70 defines a further concave surface 72 which cooperates with the further conical surface 68 of the second rotatable head 42 such that the second edge 32 of the blanket 20 is anchored between the further conical surface 68 of the second head 42 and the further concave surface 72 of the further ring 70.

A further pin 74 extends radially inwardly from the further ring 70, the further pin 74 engaging a further hole 76 defined by the second edge 32 of the blanket 20.

A further plurality of barbs 78, 79 and 80 extend away from the further concave surface 72 of the further ring 70 for assisting in anchoring the second edge 32 of the blanket 20 against the further conical surface 72 of the second rotatable head 42.

Furthermore, a further urging mechanism 82 is provided for urging the further conical surface 68 of the second head 42 axially away from the shoe 16 so that the further conical surface 68 moves towards the further concave surface 72 of the further ring 70 such that the second edge 32 of the blanket 20 is wedged between the further conical surface 68 of the second head 42 and the further concave surface 72 of the further ring 70. The arrangement is structured such that when the blanket 20 extends through the nip N and during subsequent flexing of the blanket 20, the second edge 32 of the blanket 20 is firmly anchored to the further conical surface 68 of the second rotatable head 42.

Figure 3:
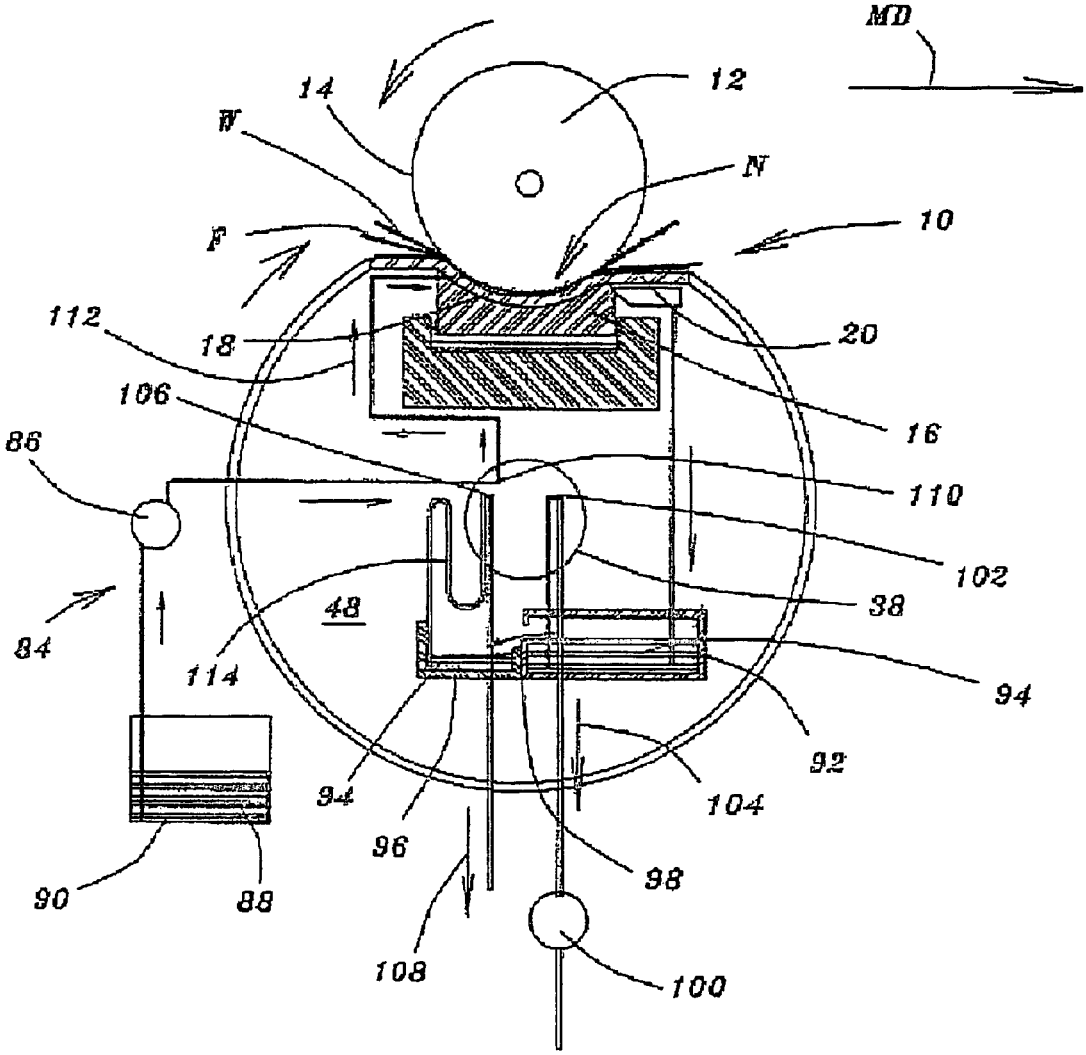
FIG. 3 is a similar view to that shown in FIG. 1 but viewed from the opposite side.

FIG. 3 is a similar view to that shown in FIG. 1 but viewed from the opposite side. As shown in FIG. 3, the press apparatus 10 also includes a lubrication system generally designated 84 for lubricating the curved surface 18 of the shoe 16 for reducing friction between the curved surface 18 and the blanket 20 during the passage of the web W supported by the blanket 20 through the nip N.

More specifically, the lubrication system 84 includes a supply pump 86 for supplying lubricant 88 from a source of lubricant 90 through one of the journals such as the back journal 38 to the curved surface 18 of the shoe 16.

A primary pan 92 is provided within the enclosure 48 for receiving therein used lubricant 94 from the curved surface 18.

A secondary pan 96 receives therein used lubricant 94 overflowing a weir or the like 98 from the primary pan 92.

Additionally, a suction pump 100 is connected to the primary pan 92 through the journal such as journal 38 for removing the used lubricant 94 from the primary pan 92. The supply pump 86 has a larger capacity than the suction pump 100. The arrangement is structured such that excess used lubricant 94 overflowing the weir 98 into the secondary pan 96 drains by gravity from the secondary pan 96 through the journal 38.

More particularly, the one journal such as journal 38 defines a first passage 102 for a first flow therethrough as indicated by the arrow 104 of the used lubricant 94 removed by the suction pump 100 from the primary pan 92.

Also, the journal 38 defines a second passage 106 for a second flow therethrough as indicated by the arrow 108 of the used lubricant 94 removed by gravity from the secondary pan 96.

Furtheremore, the journal 38 defines a third passage 110 for a third flow therethrough as indicated by the arrow 112 of the lubricant 88 supplied to the curved surface 18 of the shoe 16.

Additionally, the press apparatus 10 further includes a syphon 114 which operably connects the secondary pan 96 to the second passage 106 for maintaining a stabilized air pressure within the enclosure 48.

Additionally, as shown in FIG. 2, in a shoe press, the so called "gage" or "G" is defined as the distance between the supports or centerlines. The amount "G" is given by the addition of the shoe width "d2" plus the distance "B" between a shoe edge and the adjacent head. Where the blanket edges are clamped onto the respective heads, this distance is 2×"B", plus the distance "A" between a head and the adjacent support or journal. Therefore, this distance is 2×"A".

The shoe width is defined by the paper sheet width used in the machine. The distance "B" is a relevant component of the shoe press gage "G". Normally "B" is responsible for the fact that shoe press gages "G" are much bigger than conventional press gages and it becomes one of the main reasons for the impossibility to locate a shoe press on a conventional press frame.

The distance "B" is needed because it represents the transition zone in which, in front of the shoe press nip, the circular geometry of the blanket path at the edges (where the blanket is clamped to the circular heads) is gradually deformed, proceeding from the head toward the inside of the machine, to become a concave path where the shoe is.

In order to follow the concave geometry of the shoe, the blanket is deflected in an amount "H" which is the vertical distance from the top highest point of the circular head to the lowest point of the concave shoe. In a cross machine direction, this deflection is represented by the slope "α". Staying in the cross machine view, it is evident that the length of the deformed blanket is bigger than in the straight condition. So it can be said that in passing under the nip, the blanket suffers an overstress condition proportional to the slope "α". The bigger "α" becomes, the bigger the overstress. Therefore, "α" will have an upper acceptable limit dictated by the mechanical properties of the blanket. By fixing a certain maximum value to "α", "α" is then proportional to the ratio between "H" and "B". Accordingly, for a given "α", the bigger "H" becomes, the bigger "B" has to become and the bigger will be the total shoe press gage "G".

With regard to "H", as shown in picture 2, it appears that, how the shoe press is designed, the longer the shoe becomes in the machine direction and the bigger "H" becomes because the longer the shoe is, the lower is its lowest point.

In conclusion, for a shorter shoe in the machine direction, such as in the minishoe of the present invention, the arrangement will give a lower "H" which will give a lower "B" which will finally result in a lower "G". This feature definitely makes the minishoepress gages comparable with standard roll press gages while conventional shoe press gages are much wider. This is another main reason why a minishoe press according to the present invention can easily fit on conventional roll press frames without any need for a major rebuild. Therefore, the short shoe, besides its technological impact on the paper making process, has to be considered one of the main geometrical features of the minishoepress concept.

In operation of the apparatus 10, the web W is supported by the blanket 20. A press felt F is disposed between the blanket 20 and the web W and a further press felt (not shown) may be employed between the web W and the roll 12. However, prior to the passage of the web W through the extended nip N, the blanket 20 is attached by the first and second edge 30 and 32 thereof to the respective heads 40 and 42. The heads 40 and 42 with blanket 20 attached thereto are free to rotate about the stationary journals 36 and 38 of the axle 34. When the web W has been threaded through the nip N, the mechanism 28 is activated for urging the shoe 16 enclosed within the blanket 20 against the backing roll 12 so that as the web W extends through the nip N, water is pressed from the web W.

The urging mechanism 66 and the further urging mechanism 82 when activated, enable the locking of the edges 30 and 32 of the blanket between the respective conical and concave surfaces, 52, 56 and 68, 72.

Furthermore, the suction pump 100 rapidly forces used lubricant 94 from the primary pan 92 while excess used lubricant overflowing into the secondary pan 96 flows by gravity through the syphon 114 to drain through the second passage 106. The aforementioned arrangement enables used oil 94 to be removed from the enclosure 48 through a relatively small journal 38 while maintaining the air pressure within the enclosure 48 in equilibrium.

The present invention provides an enclosed shoe press of greatly reduced dimensions which is of relatively low cost and which can be easily installed as part of a new press section or as a rebuild press section.

What is claimed is:

1. A press apparatus for removing water from a web, said apparatus comprising:

a rotatable roll defining a peripheral surface;

an elongate shoe having a curved surface which cooperates with said peripheral surface of said roll for defining therebetween a nip for the passage therethrough of the web, the arrangement being such that when the web extends through said nip, water is pressed from the web;

a blanket disposed between said curved surface of said shoe and the web for supporting the web during said passage of the web through said nip, said blanket enclosing said shoe;

said blanket having a diameter within a range 500 mm to 875 mm;

said roll being rotatable about a longitudinal axis;

said roll including:

a first and a second side, said peripheral surface extending between said first and said second side of said roll; and said curved surface of said shoe having a machine direction length within a range 40 mm to 130 mm such that a gage of the press apparatus is comparable with a standard conventional roll press gage so that the press apparatus easily fits on a conventional roll press frame without any need for a major rebuild.

2. A press apparatus as set forth in claim 1 wherein said curved surface of said shoe has a machine direction length within a range 50 mm to 120 mm.

3. A press apparatus as set forth in claim 1 wherein said curved surface of said shoe has a machine direction length within a range 60 mm to 110 mm.

4. A press apparatus as set forth in claim 1 wherein said curved surface of said shoe has a machine direction length within a range 70 mm to 100 mm.

5. A press apparatus as set forth in claim 1 further including:

a mechanism for urging said elongate shoe towards said roll.

6. A press apparatus as set forth in claim 5 wherein said mechanism urges said shoe towards said roll with a pressure up to 220 kN/m.

7. A press apparatus as set forth in claim 5 wherein said mechanism urges said shoe towards said roll with a pressure up to 210 kN/m.

8. A press apparatus as set forth in claim 5 wherein said mechanism urges said shoe towards said roll with a pressure up to 200 kN/m.

9. A press apparatus as set forth in claim 1 wherein said blanket has a diameter within a range 650 mm to 750 mm.

10. A press apparatus as set forth in claim 1 wherein said blanket has a diameter within a range 690 mm to 710 mm.

11. A press apparatus as set forth in claim 1 wherein said blanket has a first and a second edge, a first distance between said first and said second edge of said blanket being greater than a second distance between said first and said second side of said roll.

12. A press apparatus as set forth in claim 11 wherein said press apparatus further includes:

an axle defining a first and a second journal said second journal being spaced axially relative to said first journal;

a first head rotatably connected to said first journal;

a second head rotatably connected to said second journal;

said first head defining a periphery which cooperates with said first edge of said blanket;

said second head defining a further periphery which cooperates with said second edge of said blanket such that when said heads are rotated about said journals, said blanket slides over said curved surface of said shoe so that said blanket and said heads define an enclosure, said shoe being sealed within said enclosure.

13. A press apparatus as set forth in claim 12 further including:

an anchor device for anchoring said first edge of said blanket, said anchor device comprising:

a conical peripheral surface defined by said periphery of said first head for supporting said blanket;

a ring defining a concave surface which cooperates with said conical surface of said first rotatable head such that said first edge of said blanket is anchored between said conical surface of said first head and said concave surface of said ring;

a pin extending radially inwardly from said ring, said pin engaging a hole defined by said first edge of said blanket;

a plurality of barbs extending away from said concave surface of said ring for assisting in anchoring said first edge of said blanket against said conical surface of said first rotatable head;

an urging mechanism for urging said conical surface of said first head axially away from said shoe so that said conical surface moves towards said concave surface of said ring such that said first edge of said blanket is wedged between said conical surface of said first head and said concave surface of said ring, the arrangement being structured such that when said blanket extends through said nip and during subsequent flexing of said blanket, said first edge of said blanket is firmly anchored to said conical surface of said first rotatable head;

a further conical peripheral surface defined by said further periphery of said second head for supporting said blanket;

a further ring defining a further concave surface which cooperates with said further conical surface of said second rotatable head such that said second edge of said blanket is anchored between said further conical surface of said second head and said further concave surface of said further ring;

a further pin extending radially inwardly from said further ring, said further pin engaging a further hole defined by said second edge of said blanket;

a further plurality of barbs extending away from said further concave surface of said further ring for assisting in anchoring said second edge of said blanket against said further conical surface of said second rotatable head;

a further urging mechanism for urging said further conical surface of said second head axially away from said shoe so that said further conical surface moves towards said further concave surface of said further ring such that said second edge of said blanket is wedged between said further conical surface of said second head and said further concave surface of said further ring, the arrangement being structured such that when said blanket extends through said nip and during subsequent flexing of said blanket, said second edge of said blanket is firmly anchored to said further conical surface of said second rotatable head.

14. A press apparatus as set forth in claim 12 further including:

a lubrication system for lubricating said curved surface of said shoe for reducing friction between said curved surface and said blanket during said passage of the web supported by said blanket through said nip.

15. A press apparatus as set forth in claim 14 wherein said lubrication system includes:

a supply pump for supplying lubricant from a source of lubricant through one of said journals to said curved surface of said shoe;

a primary pan for receiving used lubricant from said curved surface;

a secondary pan for receiving said used lubricant overflowing from said primary pan;

a suction pump connected to said primary pan through said one of said journals for removing said used lubricant from said primary pan, said supply pump having a larger capacity than said suction pump, the arrangement being structured such that excess used lubricant overflowing into said secondary pan drains by gravity from said secondary pan through said journal.

16. A press apparatus as set forth in claim 15 wherein said one journal defines a first passage for a first flow therethrough of said used lubricant removed by said suction pump from said primary pan;

said one journal defining a second passage for a second flow therethrough of said used lubricant removed by gravity from said secondary pan;

said one journal defining a third passage for a third flow therethrough of said lubricant supplied to said curved surface of said shoe.

17. A press apparatus as set forth in claim 16 further including:

a syphon operably connecting said secondary pan to said second passage for maintaining a stabilized air pressure within said enclosure.

18. A press apparatus as set forth in claim 12 wherein said gage G of said press apparatus is said second distance between said first and said second side of said roll plus a distance B between said first side of said roll and said first head plus a further distance between said second side of said roll and said second head plus a distance A between said first head and said first journal plus a further distance between said second head and said second journal.

19. A method for removing water from a web, said method comprising:

rotating a rotatable roll which defines a peripheral surface;

urging an elongate shoe having a curved surface which cooperates with the peripheral surface of the roll for defining therebetween a nip for the passage therethrough of the web, the arrangement being such that when the web extends through the nip, water is pressed from the web;

supporting the web on a blanket disposed between the curved surface of the shoe and the web during the passage of the web through the nip, the blanket enclosing the shoe, the blanket having a diameter within a range 500 mm to 875 mm; and rotating the roll about a longitudinal axis, the roll including:

a first and a second side, the peripheral surface extending between the first and the second side of the roll;

the curved surface of the shoe having a machine direction length within a range 40 mm to 130 mm such that a gage of the press apparatus is comparable with a standard conventional roll press gage so that the press apparatus easily fits on a conventional roll press frame without any need for a major rebuild.

* * * * *